US009254942B2

(12) United States Patent
Elliot et al.

(10) Patent No.: US 9,254,942 B2
(45) Date of Patent: Feb. 9, 2016

(54) LINERLESS CLOSURE

(71) Applicant: CLOSURE SYSTEMS INTERNATIONAL, INC., Indianapolis, IN (US)

(72) Inventors: Daniel Elliot, Indianapolis, IN (US); Navaneeth Bashyam, Indianapolis, IN (US)

(73) Assignee: Closure Systems International Inc., Indianapolis, IN (US)

( * ) Notice: Subject to any disclaimer, the term of this patent is extended or adjusted under 35 U.S.C. 154(b) by 0 days.

(21) Appl. No.: 13/735,668

(22) Filed: Jan. 7, 2013

(65) Prior Publication Data

US 2013/0175285 A1 Jul. 11, 2013

Related U.S. Application Data

(60) Provisional application No. 61/583,938, filed on Jan. 6, 2012.

(51) Int. Cl.
*B65D 41/34* (2006.01)
*B65D 41/18* (2006.01)
*B65D 41/04* (2006.01)

(52) U.S. Cl.
CPC ..... *B65D 41/18* (2013.01); *B65D 41/0428* (2013.01); *B65D 41/34* (2013.01); *B65D 41/3423* (2013.01)

(58) Field of Classification Search
CPC ..... B65D 41/0421; B65D 41/0428; B65D 41/18; B65D 41/34; B65D 41/3423
USPC ..... 215/252, 343, 344
See application file for complete search history.

(56) References Cited

U.S. PATENT DOCUMENTS

| | | | | |
|---|---|---|---|---|
| 4,061,240 | A * | 12/1977 | Brownbill | 215/270 |
| 4,210,251 | A | 7/1980 | Grussen | |
| 4,276,989 | A | 7/1981 | Hicks | |
| 4,442,947 | A | 4/1984 | Banich, Sr. | |
| 5,133,471 | A | 7/1992 | Pujol | |
| 5,161,707 | A | 11/1992 | Dutt et al. | |
| 5,769,255 | A | 6/1998 | Ohmi et al. | |
| 5,871,111 | A | 2/1999 | Pfefferkorn et al. | |
| 6,502,710 | B1 | 1/2003 | Bosl et al. | |
| 6,695,161 | B2 | 2/2004 | Kano et al. | |
| 6,913,158 | B1 | 7/2005 | Bosl et al. | |
| 2006/0255003 | A1 | 11/2006 | Fuchs | |
| 2008/0110851 | A1 * | 5/2008 | Fuchs et al. | 215/344 |

* cited by examiner

*Primary Examiner* — Fenn Mathew
*Assistant Examiner* — James N Smalley
(74) *Attorney, Agent, or Firm* — Wood, Phillips, Katz, Clark & Mortimer

(57) ABSTRACT

A linerless closure for use on an associated container includes a unitary, one-piece closure body having a top wall portion, and an annular skirt portion depending from the top wall portion. The closure includes an annular, outer seal element which depends from the top wall portion for sealing engagement with a generally outwardly facing surface of the associated container. The closure includes an inner, plug seal element depending from the top wall portion for sealing engagement with a generally inwardly facing surface of the container. Notably, the closure includes a discontinuous pressure block in the form of a plurality of circumferentially spaced, seal reinforcement elements on the inside surface of the skirt portion, adjacent the top wall portion. The reinforcement elements are engageable by the outer seal element to limit outward deflection of the outer seal element, to enhance sealing cooperation with the associated container.

12 Claims, 2 Drawing Sheets

LINERLESS CLOSURE

TECHNICAL FIELD

The present invention relates generally to plastic closures, formed from polymeric materials, for use on associated containers, more particularly to a linerless plastic closure including an improved sealing arrangement for sealing cooperation with an associated container.

BACKGROUND OF THE INVENTION

Plastic closures formed from polymeric materials have found widespread use on containers, such as for beverages or the like. While some closures of this nature may include a separate sealing liner component, many closures of this type can advantageously be formed as "linerless" closures, that is, without a separate sealing liner element. In such linerless constructions, one or more features of the closure cooperate with an associated container to provide the desired sealing performance for the closure and container package.

Experience has shown that sealing performance of such closures can be adversely affected attendant to handling of the closure and container packages, such as by impact or the like. The present invention is directed to an improved linerless closure having sealing features which facilitate enhanced sealing performance, while at the same time making efficient use of the polymeric material from which such closures are formed.

SUMMARY OF THE INVENTION

In accordance with the present invention, a plastic closure for a container comprises a closure body having a top wall portion, and an annular skirt portion depending from the top wall portion. For some applications, the skirt portion can be provided with an internal thread formation for cooperation with the external thread formation of an associated container.

In accordance with the present invention, the present closure includes an outer seal element depending from the top wall portion of the closure body inwardly of the annular skirt portion. The outer seal element is generally annular, and defines a generally inwardly facing sealing surface for engagement with a generally outwardly facing sealing surface of the associated container.

Notably, in accordance with one aspect of the present invention, the inwardly facing surface of the outer seal element tapers generally inwardly of the closure body to provide clearance between a base portion of the outer seal element and the container. This inwardly tapering configuration, which provides the outer seal element with a slanted or undercut configuration, acts to provide clearance from the associated container finish, such that damage due to impact or high pressure does not compromise the sealing integrity of the closure. Notably, the internal angle/undercut of the inside surface of the outer seal element also acts to pre-load the outer seal, to provide more sealing pressure during all package conditions.

In accordance with another aspect of the present invention, the closure includes a plurality of circumferentially spaced, seal reinforcement elements on the inside surface of the skirt portion of the closure, adjacent the top wall portion. The reinforcement elements which are illustrated as shoulder-like projections provided generally at the juncture of the top wall portion and skirt portion, are engageable by the outer seal element to limit outward deflection of the outer seal element, to thereby enhance sealing cooperation of the outer seal element with the associated container.

By this arrangement, outer seal reinforcement is provided, protruding from the side wall radially outside of the outer seal element, which acts to limit the deflection of the outer seal element during impact and high pressure situations, without adding to the hoop stiffness of the closure. Stated differently, the present invention is configured to intentionally increase the ratio or radial stiffness to hoop stiffness, which allows for minimal transfer of strain to the rest of the seal surface under external or internal load, thereby improving seal efficacy.

Thus, the seal reinforcement elements, configured as a discontinuous, deflection-limiting pressure block, act to reinforce the outside seal element in impact situations, as well as in high temperature/high pressure situations, with contact between the outer seal element and the seal reinforcement elements only occurring in these types of situations, as may be required.

Because the pressure block provided by the seal reinforcement elements is discontinuous, weight savings if desirably promoted, while disconnecting the pressure block from the primary hoop of the closure. This allows for reinforcement of the outside seal element, while keeping impact loading from affecting a broader arc of the seal surface.

A key aspect of the present invention is that it facilitates formation of lightweight closures. Due to the fact that a lightweight closure will deflect more under pressure than a relatively heavier one, the present invention has been configured to provide maximum seal pressure after axial stretch of the closure side wall and doming of the top panel have taken place.

In accordance with the illustrated embodiment, the present closure further includes an inner plug seal element depending from the top wall portion inwardly of the outer seal element. The plug seal element is generally cylindrical, and defines an outwardly facing sealing surface for sealing engagement with a generally inwardly facing, inside surface of the associated container. In the preferred form, the outwardly facing surface of the inner plug seal element has an inwardly tapered free end portion to facilitate application of the closure to a container. By this arrangement, the inner plug seal element provides a contoured, lead-in plug, which extends a greater distance from the top wall portion than the outer seal element of the closure. This configuration of the inner seal element aids in reducing application defects by providing precentering of the closure, with the inner plug seal element also acting in conjunction with the outer seal element to force the container bore into hoop expansion, thereby increasing the seal pressure on the outside diameter of the container.

In the illustrated embodiment, twelve of the seal reinforcement elements are evenly spaced about the circumference of the closure to provide the discontinuous pressure block of the present invention, with the spacing between adjacent reinforcement elements generally corresponding to the circumferential dimension of each reinforcement element.

Other features and advantages will become readily apparent from the accompanying drawings and the appended claims.

DETAILED DESCRIPTION

Figure 1:
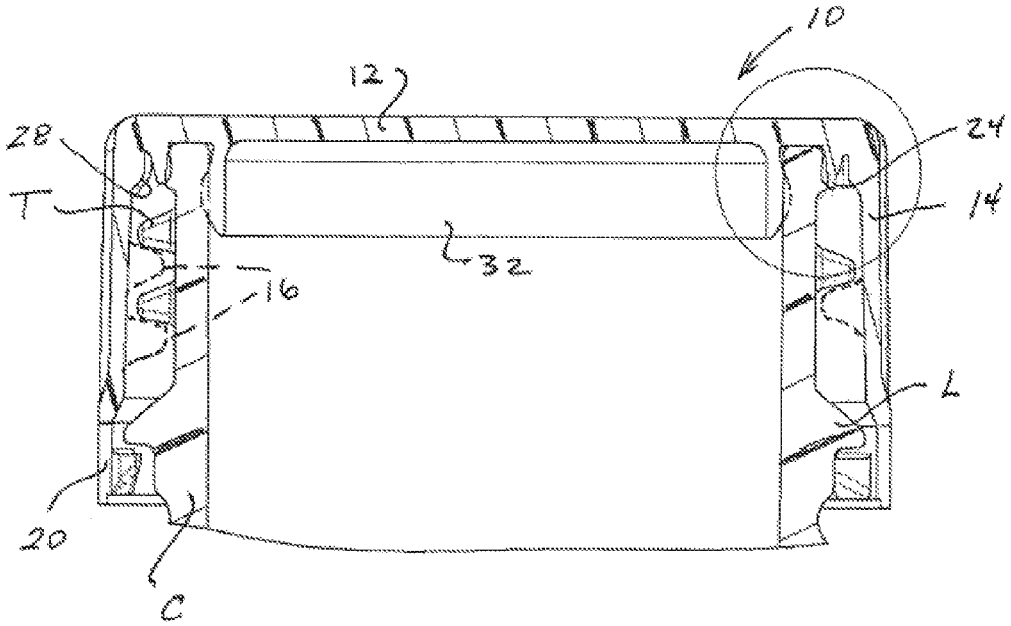
FIG. 1 is a cross-sectional, diagrammatic view of a linerless closure embodying the principles of the present invention.
Figure 2:
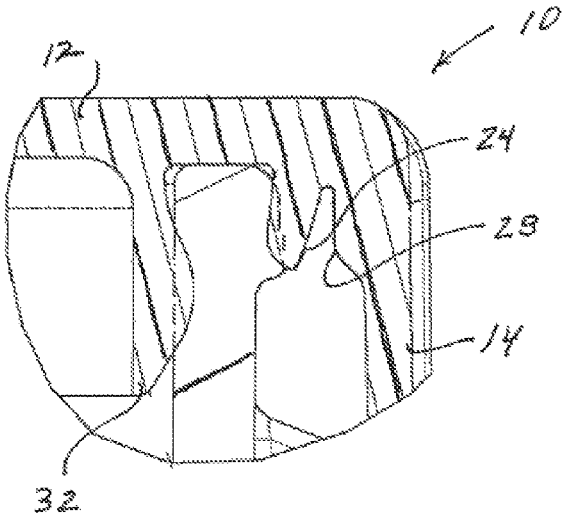
FIG. 2 is a relatively enlarged, fragmentary view of the circled portion of the closure shown in FIG. 1.
Figure 3:
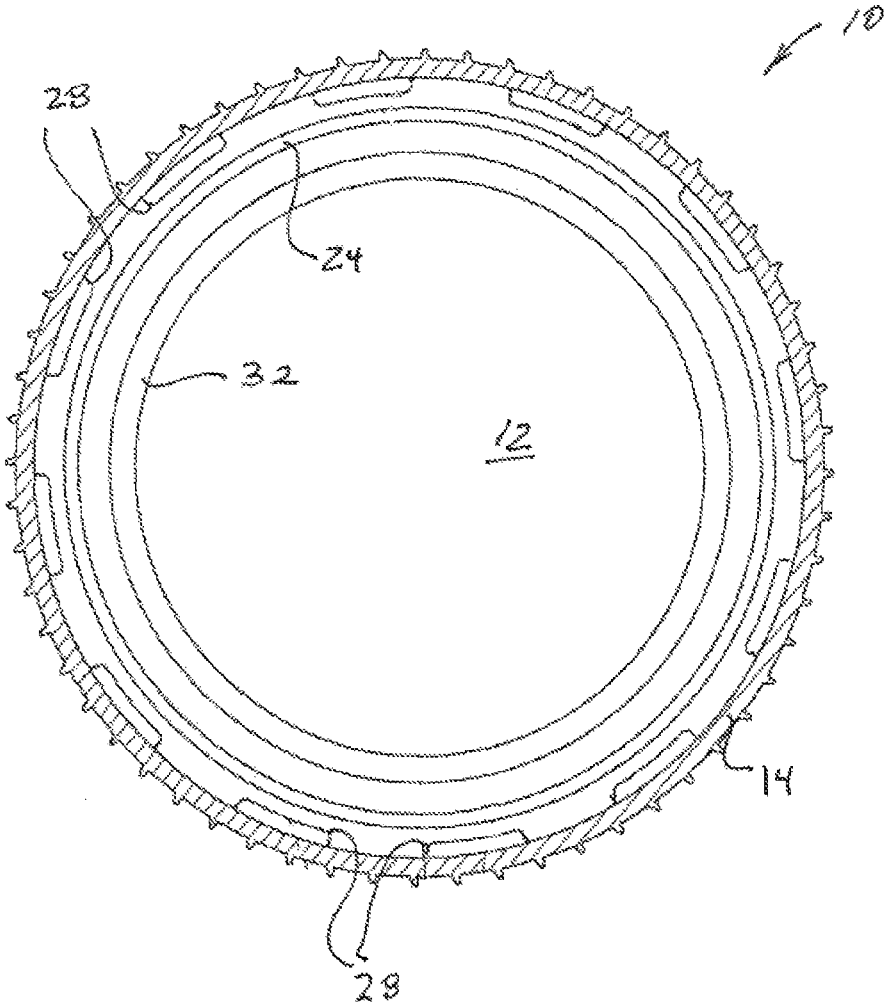
FIG. 3 is a cross-sectional view of the closure shown in FIG. 1, showing the interior of a top wall portion of the closure, and the associated sealing features.

While the present invention is susceptible of embodiment in various forms, there is shown in the drawings and will hereinafter be described a presently preferred embodiment, with the understanding that the present disclosure is to be considered as an exemplification of the invention, and is not intended to limit the invention to the specific embodiment illustrated.

With reference to the drawings, therein is illustrated a plastic closure 10 configured for cooperative, sealing engagement with an associated container C. As will be appreciated by those familiar with the art, closure 10 can be formed from suitable polymeric materials, including polypropylene, polyethylene, copolymers, polymer blends, and the like. Closure 10 can be efficiently formed by compression-molding or injection-molding techniques.

As illustrated, closure 10 includes a unitary, one-piece closure body having a top wall portion 12, and an annular skirt portion 14 depending from the top wall portion 12. For those applications where the container C includes an external thread formation T, the closure 10 can be provided with a cooperating, internal thread formation 16 (shown in phantom line in FIG. 1) on the inside surface of skirt portion 14.

For some applications, the closure 10 can be configured for tamper-indication to provide readily visually discernible evidence that the closure has been partially or completely removed from the container C. To this end, in the illustrated embodiment, closure 10 includes a tamper-indicating pilfer band 20 depending from the lower edge of the annular skirt portion 14. The pilfer band 20 can be configured to includes one or more suitable elements on its inside surface for cooperative engagement with an annular blocking ring L of the finish of the container C, whereby the pilfer band 20 is partially or completely separated from the annular skirt portion 14 as the closure 10 is removed from the container.

As illustrated, closure 10 is a so-called linerless construction, in that the unitary, one-piece closure body does not include a separate sealing element for sealing cooperation with the associated container C. Rather, the unitary one-piece closure body of closure 10 includes features specifically configured for sealing cooperation with both the inwardly and outwardly facing surfaces of the neck portion or finish of the container C.

In accordance with the present invention, closure 10 includes an outer seal element 24 depending from the top wall portion 12 of the closure body inwardly of the annular skirt portion 14. The outer seal element 24 is generally annular, and defines a generally inwardly facing sealing surface for engagement with a generally outwardly facing sealing surface of the associated container C.

In accordance with one aspect of the present invention, the inwardly facing surface of the outer seal element 24 tapers generally inwardly of the closure body to provide clearance between a base portion of the outer seal element 24, and the associated container C. This inwardly tapering configuration, which provides the outer seal element 24 with a slanted or undercut configuration, acts to provide clearance from the associated container finish, such that damage due to impact or high pressure does not compromise the sealing integrity of the closure provided by the outer seal element 24. Notably, the internal angle/undercut of the inside surface of the outer seal element 24 also acts to pre-load the outer seal element to provide more sealing pressure during all package conditions.

In accordance with another aspect of the present invention, the closure 10 includes a plurality of circumferentially spaced, seal reinforcing elements 28 on the inside surface of the skirt portion 14 of the closure 10, adjacent the top wall portion 12. The reinforcement elements 28, which are illustrated as shoulder-like projections provided generally at the juncture of the top wall portion 12 and the skirt portion 14, are engageable by the outer seal element 24 to limit outward deflection of the outer seal element, to thereby enhance sealing cooperation of the outer seal element 24 with the associated container C.

Thus, by this arrangement, outer seal reinforcement is provided, protruding from the side wall radially outside of the outer seal element 24, which reinforcement acts to limit the deflection of the outer seal element during impact and high pressure situations, without adding to the hoop stiffness of the closure. Stated differently, the present invention is configured to intentionally increase the ratio of radial stiffness to hoop stiffness, which allows for minimal transfer of strain to the rest of the seal surface under external or internal load, improving seal efficacy.

Thus, the seal reinforcement elements 28, configured as a discontinuous, deflection-limiting pressure block, act to reinforce the outer seal element 24 in impact situations, as well as in high temperature/high pressure situations, with contact between the outer seal element 24 and the seal reinforcement elements 28 only occurring in these types of situations, as may be required.

Because the pressure block provided by the seal reinforcement elements 28 is discontinuous, weight savings is desirably promoted, while disconnecting the pressure block from the primary hoop of the closure. This allows for reinforcement of the outside seal element 24, while keeping impact loading from affecting a broader arc of the seal surface.

A key aspect of the present invention is that this configuration of the seal element and seal reinforcement elements facilitates formation of light weight closures. Due to the fact that a light weight closure will deflect more under pressure than a relatively heavier one, the present invention has been configured to provide maximum seal pressure after axial stretch of the closure side wall and doming of the top wall portion have taken place.

In the illustrated embodiment, twelve of the seal reinforcement elements 28 are evenly spaced about the circumference of the closure 10 to provide the discontinuous pressure block of the present invention, with the spacing between adjacent ones of the reinforcement elements 28 generally corresponding to the circumferential dimension of each reinforcement element.

In accordance with the illustrated embodiment, the present closure 10 further includes an inner plug seal element 32 depending from top wall portion 12 inwardly of outer seal element 24. The plug seal element 32 is generally cylindrical, and defines an outwardly facing sealing surface for sealing engagement with a generally inwardly facing, inside surface of an associated container C.

In the preferred form, the outwardly facing surface of the inner plug seal element 32 has an inwardly tapered free end portion to facilitate application of the closure 10 to an associated container C. By this arrangement, the inner plug seal element 32 provides a contoured, lead-in plug, which extends a greater distance from the top wall portion 12 than the outer seal element 24 of the closure. This configuration of the inner seal element aids in reducing application defects by providing precentering of the closure 10, with the inner plug seal element 32 acting in conjunction with the outer seal element 24 to force the container bore into expansion, thereby increasing the seal pressure on the outside diameter of the container.

From the foregoing, it will be observed that numerous modifications and variations can be effected without departing from the true spirit and scope of the novel concept of the present invention. It is to be understood that no limitation with respect to the specific embodiment illustrated herein is intended or should be inferred. The disclosure is intended to cover by the appended claims all such modifications as fall within the scope of the claims.

What is claimed is:

1. A plastic closure for a container, comprising;

a closure body having a top wall portion and an annular skirt portion depending from said top wall portion, an outer seal element depending from said top wall portion inwardly of said annular skirt portion, said outer seal element being generally annular, and defining a generally inwardly facing sealing surface for engagement with a generally outwardly facing sealing surface of an associated container, and a plurality of circumferentially spaced, seal reinforcement elements on the inside surface of said skirt portion, adjacent to and extending to below said top wall portion, said reinforcement elements being engageable with said outer seal element below the top wall portion, the reinforcement elements configured and spaced to limit outward deflection of said outer seal element while limiting detrimental effects of inward impact loading over an arc of the sealing surface, to thereby enhance sealing cooperation of said outer seal element with an associated container.

2. A plastic closure for a container in accordance with claim 1, including;

an inner plug seal element depending from said top wall portion inwardly of said outer seal element, said plug seal element being generally cylindrical, and defining an outwardly facing sealing surface for sealing engagement with a generally inwardly facing, inside surface of an associated container.

3. A plastic closure for a container in accordance with claim 2, including said outwardly facing sealing surface of said inner plug seal having an inwardly tapered free end portion to facilitate application of said closure.

4. A plastic closure for a container in accordance with claim 1, wherein said inwardly facing sealing surface of said outer seal element tapers generally inwardly of said skirt portion of said closure body to provide clearance between a base portion of said outer seal element and an associated container.

5. A plastic closure for a container in accordance with claim 1, wherein said closure includes twelve of said seal reinforcement elements evenly spaced about the circumference of said closure.

6. A plastic closure for a container, comprising:

a closure body having a top wall portion and an annular skirt portion depending from said top wall portion, and an outer seal element depending from said top wall portion inwardly of said annular skirt potion, said outer seal element being generally annular, and defining a generally inwardly facing sealing surface for engagement with a generally outwardly facing sealing surface of an associated container, said inwardly facing surface of said outer seal element tapering generally inwardly of said closure body to provide clearance between a base portion of said outer seal element and said container, including a plurality of circumferentially spaced, seal reinforcement elements on the inside surface of said skirt portion, adjacent to and extending to below said top wall portion, said reinforcement elements configured and spaced to engage said outer seal element to limit outward deflection of said outer seal element below the top wall portion while limiting detrimental effects of inward impact loading over an arc of the sealing surface, to thereby enhance sealing cooperation of said outer seal element with an associated container.

7. A plastic closure for a container in accordance with claim 6, including;

an inner plug seal element depending from said top wall portion inwardly of said outer seal element, said plug seal element being generally cylindrical, and defining an outwardly facing sealing surface for sealing engagement with a generally inwardly facing, inside surface of an associated container.

8. A plastic closure for a container in accordance with claim 7, including said outwardly facing sealing surface of said inner plug seal having an inwardly tapered free end portion to facilitate application of said closure.

9. A plastic closure for a container in accordance with claim 1, wherein the circumferentially spaced seal reinforcement elements are spaced a distance outwardly from the outer seal element with the plastic closure fully secured to an associated container.

10. A plastic closure for a container in accordance with claim 6, wherein the circumferentially spaced seal reinforcement elements are spaced a distance outwardly from the outer seal element with the plastic closure fully secured to an associated container.

11. A plastic closure for a container in accordance with claim 1, in combination with a container to which the plastic closure is secured.

12. A plastic closure for a container in accordance with claim 6, in combination with a container to which the plastic closure is secured.

* * * * *